US008968112B1

(12) United States Patent
Torson

(10) Patent No.: US 8,968,112 B1
(45) Date of Patent: Mar. 3, 2015

(54) GOLF HOLE CUP SETTER

(71) Applicant: Brent C. Torson, Terrebonne, OR (US)

(72) Inventor: Brent C. Torson, Terrebonne, OR (US)

( * ) Notice: Subject to any disclaimer, the term of this patent is extended or adjusted under 35 U.S.C. 154(b) by 90 days.

(21) Appl. No.: 13/815,190

(22) Filed: Feb. 6, 2013

(51) Int. Cl.
*A63B 57/00* (2006.01)
*A01B 45/04* (2006.01)

(52) U.S. Cl.
CPC ..... *A63B 57/0068* (2013.01)
USPC ..... 473/175; 172/22

(58) Field of Classification Search
USPC ..... 473/173–179; 172/22
See application file for complete search history.

(56) References Cited

U.S. PATENT DOCUMENTS 4,836,294 A * 6/1989 Bencriscutto ..... 172/22
5,228,685 A * 7/1993 Williamson ..... 473/176
5,316,292 A * 5/1994 Browne ..... 172/1
5,382,018 A * 1/1995 Browne ..... 473/409
5,662,179 A * 9/1997 Falk ..... 175/20
6,267,688 B1 * 7/2001 Morelli, Sr. ..... 473/179
6,767,289 B2 * 7/2004 Porter ..... 473/175
7,226,361 B2 * 6/2007 Garske ..... 473/175
2002/0173366 A1 * 11/2002 Lister ..... 473/174
2008/0179099 A1 * 7/2008 McNulty ..... 175/162

FOREIGN PATENT DOCUMENTS

CA 2185589 * 3/1997 ..... A63B 57/00
WO WO 9715357 A1 * 5/1997 ..... A63B 57/00

* cited by examiner

*Primary Examiner* — Mark Graham
(74) *Attorney, Agent, or Firm* — Robert E. Howard

(57) ABSTRACT

A golf hole cup setter for inserting a cylindrical golf hole cup into a golf hole so that its longitudinal axis is in vertical alignment. The cup setter has a base plate having an upper surface and a lower surface. A cup insertion member extends downwardly from the lower surface of the base plate, and is configured to contact the upper rim of the cup. A level is attached to the base plate and is positioned to allow a user to step on the base plate without interference during cup insertion, and to determine whether the longitudinal axis of the golf hole cup inserted into the golf hole by the cup setter is in vertical alignment.

6 Claims, 2 Drawing Sheets

GOLF HOLE CUP SETTER

BACKGROUND OF THE INVENTION

The present invention relates to a cup setter device for setting a cup within a hole located on a golf course green.

Each green on a golf course has a single hole which is typically moved about the green from time to time. Using a standard sized hole cutter a cylindrical hole is cut through the turf and into the soil beneath it, and the cylindrical plug of earth formed by the hole cutter removed. After the hole is formed a metal or plastic cup of a standard size is inserted into the hole and pushed downwardly with a conventional cup setter by using the foot and body weight of the user until the flange of the cup setter contacts the surface of the green. At the point where the flange of the cup setter contacts the surface of the green the top of the cup is one inch below the surface of the green, as prescribed by regulations. The bottom of the cup has a flagstick receptacle and the person setting the cup judges whether the cup is properly set by inserting the flagstick into its receptacle within the cup and visually determining if its longitudinal axis is vertical. If the flagstick is not vertical the placement of the cup must be adjusted by partially removing the cup, kicking it in the estimated direction to achieve vertical placement, re-inserting the cup, re-checking the vertical alignment with a flagstaff, etc., which can be quite laborious.

SUMMARY OF THE INVENTION

It is an object of the present invention to provide a cup setter that allows the user to insure that the cup being set in a golf hole will be positioned to hold the longitudinal axis of a flagstick in vertical alignment.

The cup setter has a base plate having an upper surface and a lower surface.

A cup insertion member extends downwardly from the lower surface of the base plate, and is configured to contact the upper rim of a golf hole cup.

A spirit level is attached to the base plate at a location that does not interfere with a user standing on the base plate during cup insertion. The spirit level is positioned to allow a user to determine the vertical alignment of the longitudinal axis of the golf hole cup.

DESCRIPTION OF PREFERRED EMBODIMENTS

Figure 1:
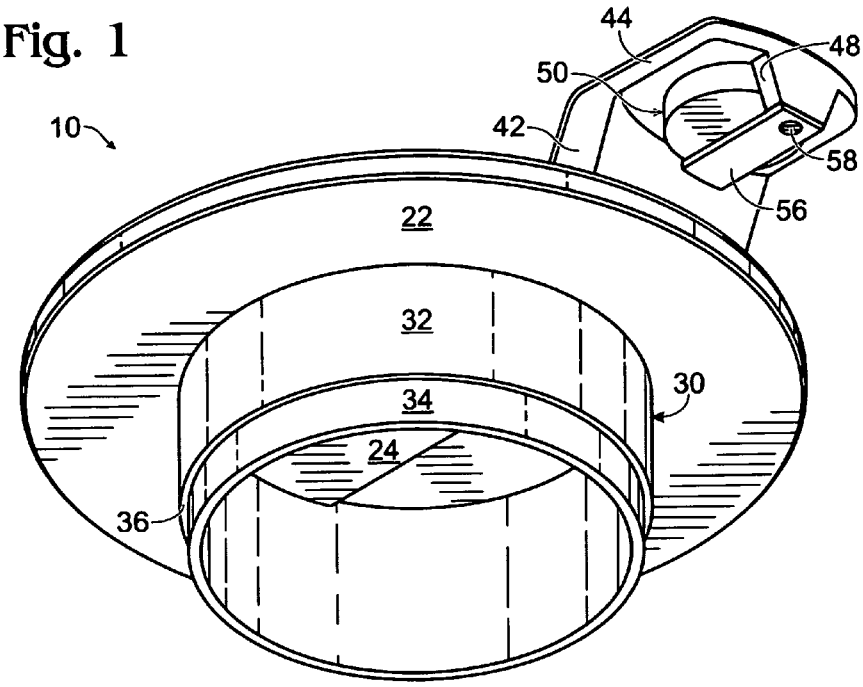
FIG. 1 is a bottom perspective view of the cup setter of the present invention.
Figure 2:
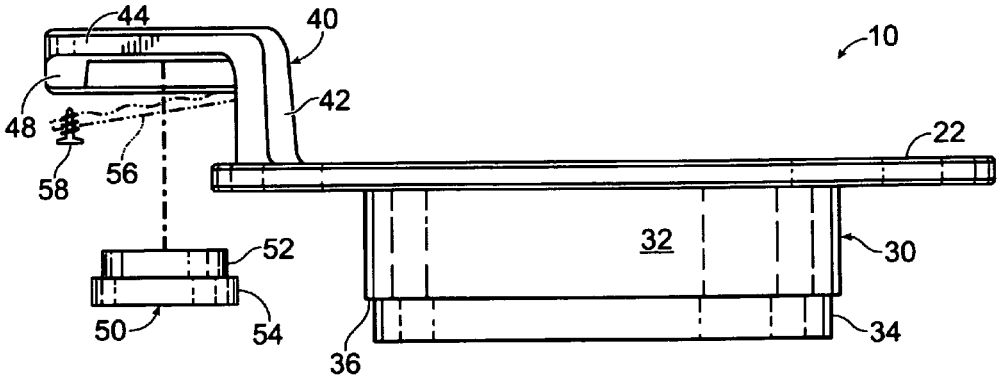
FIG. 2 is an exploded side elevation view of the cup setter.
Figure 3:
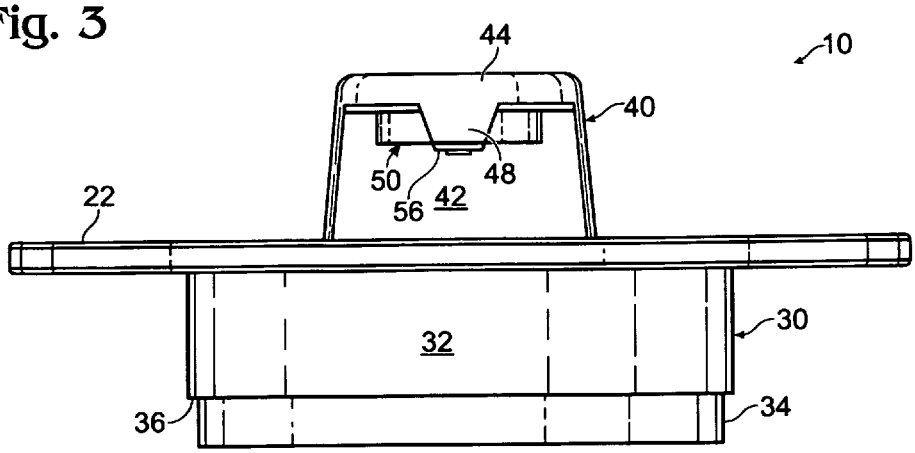
FIG. 3 is a rear elevation view of the cup setter.
Figure 4:
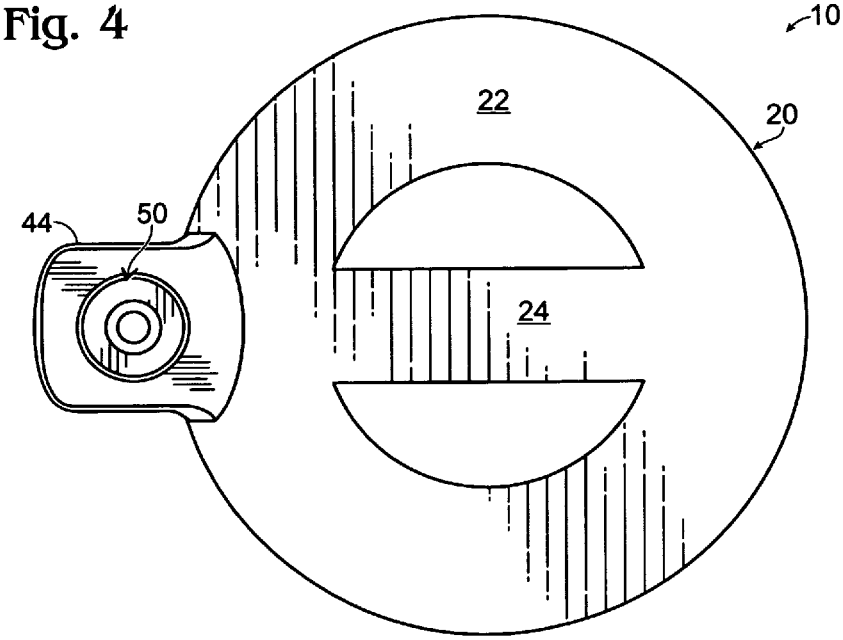
FIG. 4 is a top plan view of the cup setter.

The cup setter 10 of the present invention includes a base plate 20 having a circular, donut-shaped portion 22 and a cross member 24. Circular portion 22 has upper and lower surfaces.

Cross member 24 can be attached to circular portion 22 by any suitable means, such as welding, or can be formed integral there with by molding. The openings formed between cross member 24 and the inner circumference of donut-shaped portion of base plate 20 allows air to escape from the hole as the cup is being inserted. Alternatively, base plate 20 can be a circular disk with a plurality of openings in its central portion to allow air to escape.

Extending downwardly from the lower surface of circular portion 22 is a cylindrical cup insertion member 30 having upper and lower cylindrical portions 32 and 34, respectively. The outer diameter of lower cylindrical portion 34 is selected to fit snugly inside a golf hole cup. The outer diameter of the upper cylindrical portion 32 is larger than the diameter of the lower cylindrical portion 34 and is selected to fit snugly within the hole cut into the ground of the green removed to receive the cup. The height of upper cylindrical portion 32 is one inch, the officially prescribed distance the top of a cup must be below the green surface. The ledge 36 formed at the juncture of upper and lower cylindrical portions 32 and 34 of cylindrical member 30 is configured to contact the upper lip of the cup.

A level holder stanchion 40 is located adjacent the outer edge of circular portion 22 of base plate 20. Level holder stanchion 40 is preferably an L-shaped member having a vertical leg 42 and a horizontal leg 44.

The major plane of vertical leg 42 is preferably substantially perpendicular to the plane of base plate 20.

The major plane of horizontal leg 44 is parallel to the plane of base plate 20. Horizontal leg 44 has a downwardly depending level stop member 48.

Horizontal leg 44 has a circular opening 46 for receiving a circular type spirit level 50, also known as a "bulls eye" spirit level. The inner end of level 50 abuts the upper portion of horizontal leg 44 and the outer end abuts stop member 48. Circular level 50 has an upper diameter 52 that is slightly less than the diameter of circular opening 46 of horizontal leg 44 to form a snug fit therein. Circular level 50 has a lower diameter 54 which is larger than the diameter of circular opening 46 of horizontal leg 44 to form a ledge which abuts against the lower surface of horizontal leg 44. Although a circular type spirit level 50 is preferred, other types and/or shapes of levels could be used.

A level latch member 56 is pivotally attached at its inner end to the upper portion of horizontal leg 44, and is removably attached at its outer end to stop member 48 by any suitable means, such as threaded fastener 58. The top of latch member 56 abuts the bottom surface of level 50.

Level holder stanchion is configured to hold spirit level 50 in a location that will not interfere with the placement of a user's boot on plate 20.

In use, a conventional golf green hole cutter is used to cut a cylindrical hole through the turf and into the soil beneath it on a golf green in a manner well known in the art. The cylindrical plug of earth formed by the hole cutter is then removed.

A conventional golf hole cup is partially placed into the just-formed hole. The cup setter 10 is placed on top of the cup with the lower portion 34 of cup insertion member 30 positioned inside the cup and the ledge 36 formed between upper portion 32 and lower portion 34 being placed into abutment with the upper rim of the cup.

The user then steps onto the base plate 20 and pushes downwardly with his/her body weight until the lower surface of circular portion 22 of base plate 20 comes into contact with the surface of the green. At that point the user can determine if the longitudinal axis of the cup is in a vertical position by reference to level 50 by reference to the bubble in spirit level 50. If not level, final leveling is accomplished by the user simply pressing his/her foot on the appropriate side of plate 20 to center the bubble in level 50, thereby bringing the longitudinal axis of the cup into vertical alignment.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A golf hole cup setter for inserting a cylindrical golf hole cup into a golf hole, said golf hole cup having an upper rim and a longitudinal axis, comprising:

a base plate having an upper surface and a lower surface;

a cap insertion member extending downwardly from said lower surface of said base plate, said cap insertion member being configured to contact said upper rim of said cup;

a stanchion located adjacent the outer edge of said base plate, said stanchion having a vertical leg extending upwardly from the upper surface of said base plate and a horizontal leg extending outwardly from the upper portion of said vertical leg; and a level attached to said stanchion in a position that allows a user to step on the base plate without interference therewith during cup insertion, and to determine whether the longitudinal axis of the golf hole cup inserted into the golf hole by the cup setter is in vertical alignment.

2. The cup setter of claim 1 wherein said base plate is circular.

3. The cup setter of claim 2 wherein said base plate has a plurality of openings in its central portion.

4. The cup setter of claim 3 wherein said base plate is donut-shaped and has a cross member extending between opposing sides.

5. The cup setter of claim 1 wherein said horizontal leg of said stanchion has an opening extending there through, and said level is removably attached within said opening.

6. The cup setter of claim 5 wherein said level is a circular type spirit level.

* * * * *